US010753107B2

(12) United States Patent
Mort et al.

(10) Patent No.: US 10,753,107 B2
(45) Date of Patent: Aug. 25, 2020

(54) SELF-ADHERED SHEET INSTALLATION DEVICES AND METHODS OF USE

(71) Applicant: TREMCO INCORPORATED, Beachwood, OH (US)

(72) Inventors: Steven Douglas Mort, New South Wales (AU); Charles Houk, Broadview Heights, OH (US)

(73) Assignee: Tremco Incorporated, Beachwood, OH (US)

( * ) Notice: Subject to any disclaimer, the term of this patent is extended or adjusted under 35 U.S.C. 154(b) by 136 days.

(21) Appl. No.: 16/092,032

(22) PCT Filed: Apr. 11, 2017

(86) PCT No.: PCT/US2017/026906
§ 371 (c)(1),
(2) Date: Oct. 8, 2018

(87) PCT Pub. No.: WO2017/180558
PCT Pub. Date: Oct. 19, 2017

(65) Prior Publication Data

US 2019/0161979 A1 May 30, 2019

Related U.S. Application Data

(60) Provisional application No. 62/320,680, filed on Apr. 11, 2016.

(51) Int. Cl.

| | |
|---|---|
| ***E04F 21/00*** | (2006.01) |
| ***B44C 7/06*** | (2006.01) |
| ***B65H 35/00*** | (2006.01) |
| ***E04D 15/06*** | (2006.01) |

(52) U.S. Cl.
CPC ..... *E04F 21/00* (2013.01); *B44C 7/06* (2013.01); *B65H 35/008* (2013.01); *B65H 35/0013* (2013.01); *E04D 15/06* (2013.01)

(58) Field of Classification Search
USPC ..... 156/71
See application file for complete search history.

(56) References Cited

U.S. PATENT DOCUMENTS 1,960,850 A * 5/1934 Lloyd ..... B44C 7/02 156/526
2,357,992 A * 9/1944 Banghart ..... B44C 7/04 118/415
4,460,433 A * 7/1984 Boyd ..... B29C 65/00 156/574

(Continued)

FOREIGN PATENT DOCUMENTS

ES 2122824 A1 12/1998

OTHER PUBLICATIONS

Search Report and Written Opinion for International Application No. PCT/US2017/026906 dated Jun. 27, 2017.

*Primary Examiner* — Sing P Chan
(74) *Attorney, Agent, or Firm* — Calfee, Halter & Griswold LLP

(57) ABSTRACT

An exemplary self-adhered membrane installation device includes a frame, a handle extending from the frame, a carrier for a roll of self-adhered membrane, and a plurality of rollers for feeding the self-adhered membrane through the installation device so that the self-adhered membrane can be applied.

20 Claims, 4 Drawing Sheets

(56) References Cited

U.S. PATENT DOCUMENTS 4,648,935 A * 3/1987 Brown ..... B65H 37/005 156/577
4,795,152 A * 1/1989 Suiter ..... A63D 1/04 156/71
4,806,184 A * 2/1989 Shannon ..... B44C 7/06 156/191
4,867,816 A * 9/1989 Suiter ..... A63D 1/04 156/71
4,913,766 A * 4/1990 Lojdstrom ..... B65H 35/0033 156/523
4,944,514 A * 7/1990 Suiter ..... A63D 1/04 156/159
5,038,492 A * 8/1991 Bryant ..... E04G 21/1891 156/523
5,042,221 A * 8/1991 Pacione ..... E04F 21/00 156/574
5,050,529 A * 9/1991 Pardee ..... B44C 7/06 118/40
5,403,432 A * 4/1995 Burch ..... B44C 7/06 156/577
5,445,704 A * 8/1995 Dizon ..... B44C 7/06 156/574
5,453,152 A * 9/1995 Mazzola ..... B44C 7/02 156/523
5,478,432 A * 12/1995 Vester ..... B44C 7/06 156/523
5,628,867 A * 5/1997 Renaud ..... B44C 7/04 156/524
5,730,817 A * 3/1998 Feygin ..... B32B 37/1045 156/64
6,158,192 A * 12/2000 Gardner ..... B65B 67/085 156/577
6,808,586 B1 * 10/2004 Steinhardt ..... B29C 63/024 156/269
6,824,638 B1 * 11/2004 Anderson ..... G09F 15/02 156/229
7,204,288 B2 * 4/2007 Kinne ..... B29C 63/024 156/574
7,226,521 B2 * 6/2007 Steinhardt ..... B65H 35/002 156/249
D573,429 S * 7/2008 McCarthy ..... D8/51
7,413,626 B2 * 8/2008 Anderson ..... B29C 63/0013 156/715
7,540,933 B2 * 6/2009 Dugas ..... B29C 63/024 156/269
7,722,938 B2 * 5/2010 Truog ..... B32B 7/06 428/40.1
2006/0144512 A1 7/2006 Carroll et al.
2010/0269981 A1 10/2010 Kalwara et al.
2013/0186570 A1 7/2013 Doniger et al.
2016/0376792 A1 12/2016 Danielson
2019/0161979 A1 * 5/2019 Mort ..... B44C 7/06

* cited by examiner

SELF-ADHERED SHEET INSTALLATION DEVICES AND METHODS OF USE

CROSS-REFERENCE TO RELATED APPLICATIONS

The present application is a U.S. national stage entry of PCT/US2017/02906, filed Apr. 11, 2017, which claims the benefit of U.S. Provisional Application Ser. No. 62/320,680, filed on Apr. 11, 2016, titled SELF-ADHERED SHEET INSTALLATION DEVICES AND METHODS OF USE, the disclosures of which are incorporated herein by reference in its entirety.

TECHNICAL FIELD

The present invention relates generally to installation equipment for a sheet of self-adhered material and methods of using the same.

BACKGROUND OF THE INVENTION

In constructing a building, an air and vapor barrier is typically provided between the interior and the exterior of the building. Below grade, water barriers may also be used. Generally, the barrier system is configured to "seal" the entire structure. Self-adhesive air and vapor barriers are known to those skilled in the art, e.g. Tremco ExoAir® self-adhesive air and vapor barrier membranes. These air and vapor barriers are typically provided in rolls that can be about 36" to 48" wide, as shown in FIG. 1. A strong adhesive is used on the membrane to ensure that it can stick to various building materials, such as concrete, metal, and wood surfaces. A backing layer covers the adhesive to prevent the membrane from sticking to itself when provided in a roll. The backing layer is peeled off and discarded during installation of the membrane.

As shown in FIG. 1, the self-adhered membrane 102 is unrolled from a roll 100 during installation and the backing layer 104 is peeled away so that the membrane can be applied to a building surface 101. Rolls of self-adhered membrane can weigh up to about 40-50 lbs. and may require multiple people to lift during installation. Additional workers may need to assist with installation because of the width of some rolls and the need to peel away the backing layer as the membrane is installed. The membrane may be pressed with a roller after installation to ensure that the membrane has adhered properly.

SUMMARY

Exemplary embodiments of self-adhered sheet installation device and methods of using the same are disclosed herein.

An exemplary self-adhered membrane installation device includes a frame, a handle extending from the frame, a carrier for a roll of self-adhered membrane, and a plurality of rollers for feeding the self-adhered membrane through the installation device so that the self-adhered membrane can be applied.

Another exemplary embodiment of the present disclosure relates to a self-adhered membrane installation device in combination with a roll of self-adhered membrane having an adhesive membrane layer and a backing layer. The device includes a frame; at least one handle extending from the frame; a carrier for rotatably receiving a roll of self-adhered membrane and positioned so that the roll of self-adhered membrane does not contact a building surface when the installation device is applied to the building surface; a pressure roller rotatably attached to the frame and positioned so that at least a portion of the pressure roller engages the building surface to press the adhesive membrane layer of the self-adhered membrane against the building surface when the installation device is applied to the building surface; a support roller rotatably attached to the frame and positioned so that at least a portion of the pressure roller engages the building surface when the installation device is applied to the building surface; and a collecting roller rotatably attached to the frame and positioned so that at least a portion of the collecting roller engages the support roller such that rotation of the support roller causes the collecting roller to rotate to collect the backing layer of the self-adhered membrane. The self-adhered membrane is rotatably installed on the carrier portion of the device and is unrolled by the device.

Another exemplary embodiment of the present disclosure relates to a method for using a self-adhered sheet installation device. The method includes: providing a supply of self-adhered membrane in roll form, the self-adhered membrane having a membrane layer and a backing layer; providing an installation device; feeding an unrolled portion of the self-adhered membrane through the installation device; mounting the remaining roll of self-adhered membrane in the installation device; separating the backing layer from the membrane layer; applying the membrane layer of the self-adhered membrane to a building surface; pressing the self-adhered membrane against the building surface; and collecting the backing layer on a collection roller of the installation device.

BRIEF DESCRIPTION OF THE DRAWINGS

These and other features and advantages of the present invention will become better understood with regard to the following description and accompanying drawings in which.

DETAILED DESCRIPTION

This Detailed Description merely describes exemplary embodiments of the invention and is not intended to limit the scope of the claims in any way. Indeed, the invention as claimed is broader than the exemplary embodiments, and the terms used in the claims have their full ordinary meaning, unless a limiting definition is expressly provided herein.

The present disclosure describes an installation device for self-adhered membranes. A supply of self-adhered membrane is typically provided in a roll form. The roll of self-adhered membrane is attached to and supported by a frame of the installation device. To apply the membrane to the exterior of a building, an installer partially unrolls the membrane and feeds it through a series of rollers of the device to present an adhesive side of the membrane on the exterior of the device. The installer then lifts the device and presses the exposed adhesive portion of the membrane against the surface of the building, the rollers of the device pressing the adhesive membrane to install it on the surface. If the membrane has a backing layer, the backing layer can be peeled away by the installer and fed through separate rollers for collection. The installation device provides the installer with mechanical advantage to support the weight of the roll of membrane and provides improved control over hand-installation of the same self-adhered membrane.

Figure 1:
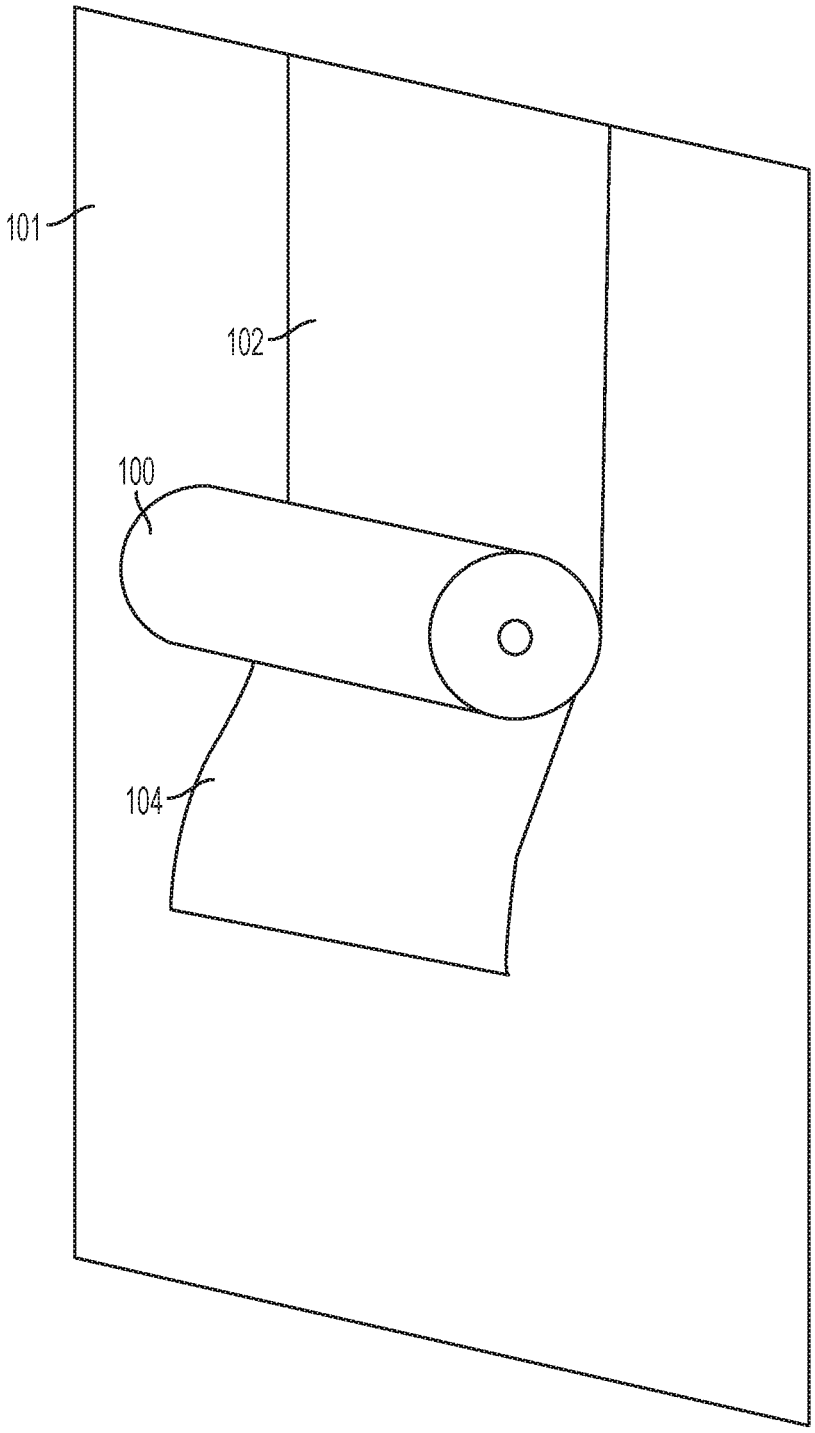
FIG. 1 is a perspective view of a roll of self-adhered membrane being applied to a surface by a prior art manual means.
Figure 2:
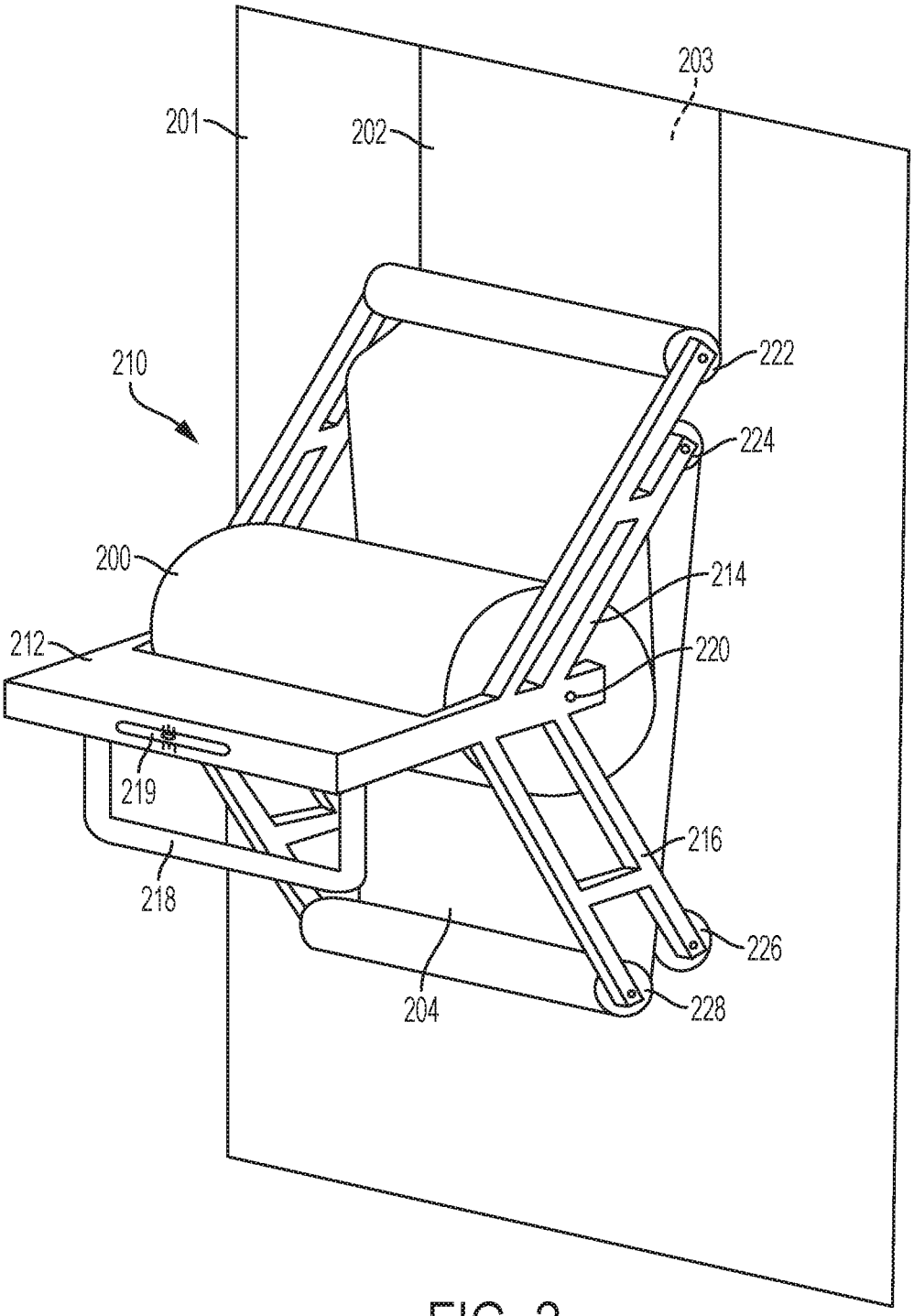
FIG. 2 is a perspective view of a roll of self-adhered membrane being applied to a surface with an exemplary installation device.
Figure 3:
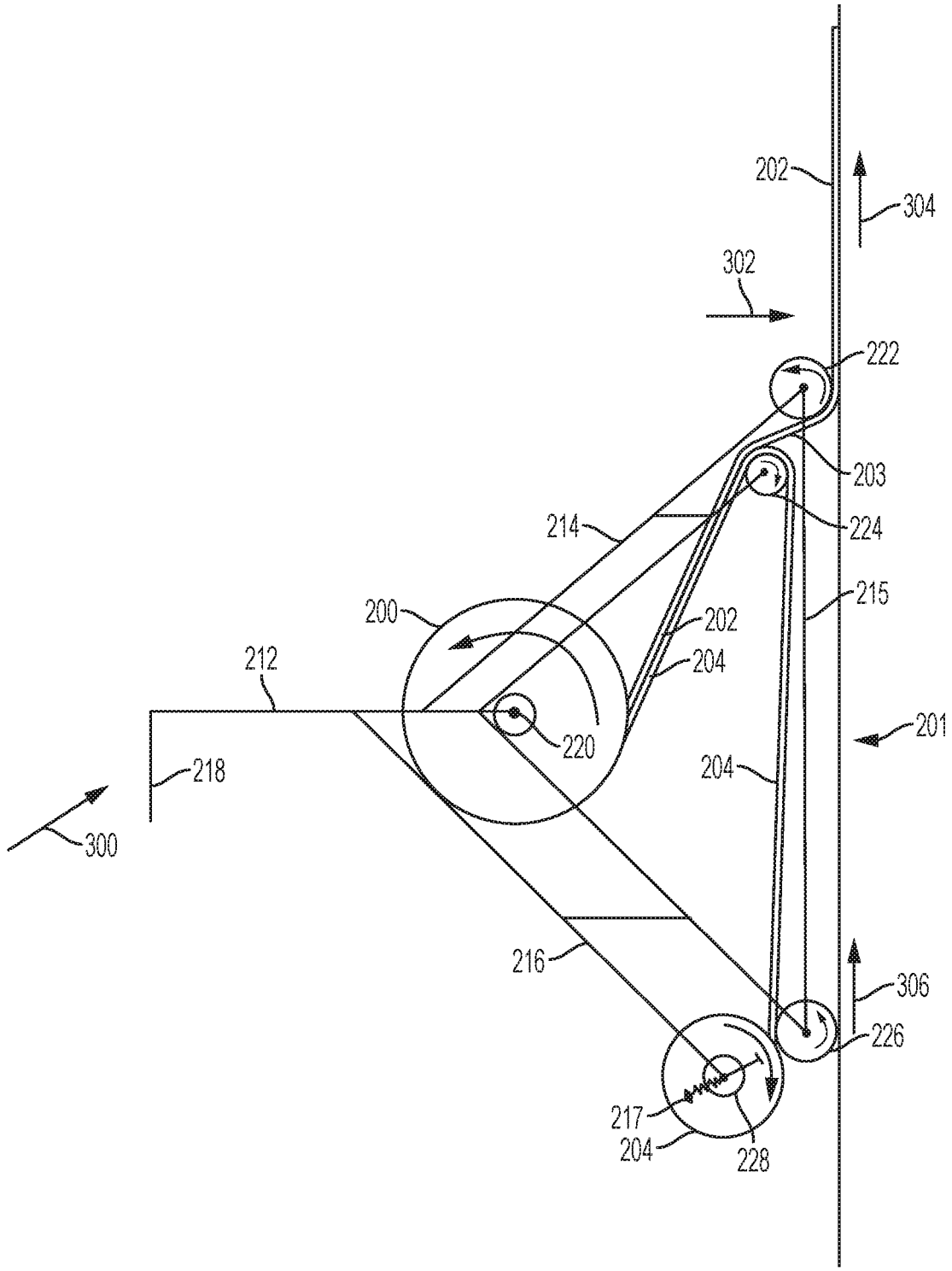
FIG. 3 is a side view of the roll of self-adhered membrane and exemplary installation device of FIG. 2, with the frame represented in the abstract by lines to more clearly illustrate the path of the installation device.

Referring now to FIGS. 2 and 3, an exemplary self-adhered sheet installation device 210 is shown applying a roll of self-adhered membrane 200 to a building surface 201. The roll of self-adhered membrane 200 includes a membrane layer 202 and a backing layer 204. The backing layer 204 is attached to an adhesive side 203 of the membrane layer 202. The installation device 210 includes a base or base frame 212, a first frame 214, a second frame 216, a handle 218 extending from the base 212, a pressure roller 222, a feeding roller 224, a support roller 226, and a collection roller 228. The base 212 may also include a level 219 to help a worker align a sheet being installed on a vertical surface. While the device 210 is shown with a roll 200 of self-adhered membrane being applied to a vertical surface, any sheet material in roll form could be used in the device for faster and easier installation in a vertical, horizontal, or other orientation.

The base 212 carries the roll 200 and helps to transfer the weight of the roll 200 through the frames 214, 216 to the building surface 201 and the worker (not shown). A rotatable roll support 220 retains the roll 200 within the device 210 while allowing the roll 200 to rotate as the membrane is dispensed and applied to the building surface 201. The position of the roll 200 within the device 210 also allows the device 210 to be set down on the ground without the roll 200 being damaged. In some embodiments, the roll support 220 has two conical rollers that engage each end of the roll 200. In some embodiments, the roll support 220 is adjustable to accommodate rolls 200 having different widths. In some embodiments, the width of the base 212 is changed to accommodate different size rolls 200. In some embodiments, first and second frames 214, 216 extend from one end of the base 212 and the roll 200 is supported from one side. While the base 212 is shown as a rectangular structure in FIG. 2, the base 212 may take on any shape suitable of supporting the roll 200 and the frames 214, 216, such as, for example, an arcuate or cylindrical shape.

The base 212 is formed of strong and rigid material capable of supporting the weight of the roll 200 and the force applied by a worker to press the adhesive side 203 of the membrane 202 against the building surface 201. In some embodiments, the base is formed of a solid block of metal, and in some other embodiments, the base is formed of bent and welded sheet metal. The base 212 may be formed of any suitably rigid, strong, and light weight material, such as, for example, metal (e.g. aluminum, titanium, magnesium, steel, or the like, or any alloy of these metals), plastic, wood, or the like.

The first frame 214 and second frame 216 extend from the base 212 toward the building surface 201. Each frame 214, 216 extends from the base 212 at an angle to provide space between the base 212 and the surface 201 for the roll of self-adhered membrane 200 while still allowing the installer to be close to the surface 201 during installation of the membrane 202. In some embodiments, a cross-piece or third frame 215 joins the first and second frames 214, 216 to provide additional rigidity and strength. The first and second frames 214, 216 distribute the force applied to the base by a worker during operation to the building surface 201 through the pressure and support rollers 222, 226. In some embodiments, the second frame 216 extends downward from the base 212 at a 60 degree angle relative to the substantially horizontal base 212. In some embodiments the rollers are disposed to one side of an installation device and have a free end. In some embodiments, the rollers are each divided and extend from both sides of an installation device. The first and second frames 214, 216, and optional cross-piece 215 may be formed of any suitably rigid, strong, and light weight material, such as, for example, metal (e.g. aluminum, titanium, magnesium, steel, or the like, or any alloy of these metals), plastic, wood, or the like.

In some embodiments, the rollers 222, 224, 226, 228 are the same diameter. The rollers 222, 224, 226, 228 may have any diameter suitable for guiding and applying the membrane 202. In some embodiments, the pressure and support rollers 222, 226 have a 3 inch diameter and the feeding and collecting rollers 224, 228 have a 2 inch diameter. In some embodiments, the rollers 222, 224, 226, 228 each have a different diameter. In some embodiments, the rollers 222, 224, 226, 228 are made from high durometer silicone rubber, polyethylene, urethane, or any other material that is resistant to abrasion, cleaning solvents, and petroleum-based fluids. In some embodiments, additional rollers or wheels are provided to guide the installation device along a path on the building surface 201.

The pressure roller 222 and feeding roller 224 are supported by the first frame 214. The support roller 226 and collection roller 228 are supported by the second frame 216. The rollers 222, 224, 226, 228 may be rotatably attached to the frames 214, 216 in any way, such as, for example, with bushings, bearings, or the like. In some embodiments, the support roller 226 is not a single roller but instead includes multiple wheels (not shown) that support the device 220 as it rides along the building surface 201. In some embodiments, the pressure roller 222, feeding roller 224, and collecting roller 228 are rotatably attached to the first and second frames 214, 216 such that they can rotate freely (when not in use), while the support roller 226 is rotatably attached to the second frame 216 such that the support roller 226 provides increased rolling resistance. In other words, more torque is required to turn the support roller 226 than the other rollers 222, 224, 228. For example, in some embodiments, ball bearings may be used to attach the pressure, feeding, and collecting rollers 222, 224, 228, while the support roller 226 may include a plain bearing. In some embodiments, the support roller 226 may be attached to the second frame 216 include a means of adjusting the rolling resistance of the support roller 226, such as, for example, a brake, an adjustable rotary dashpot, or the like.

The collecting roller 228 is positioned so that at least a portion of the collecting roller 228 engages the support roller 226 such that rotation of the support roller 226 causes the collecting roller 228 to rotate. The backing layer 204 is collected on the collecting roller 228 to prevent the backing layer 204 from getting in the way of the installation of the membrane, or from causing a trip hazard and reducing debris at the work site. The collecting roller 228 is configured such that it can accommodate the accumulation of the backing layer 204. In some embodiments, a middle portion of the collecting roller 228 (between the end portions) engages the support roller 226. In some embodiments, the collecting roller 228 does not directly engage the support roller 226 and is instead rotated by other means, such as, for example, a belt drive, a chain drive, a gear drive, a motor, a crank, or the like. In some embodiments, the collecting roller 228 is adjustably or moveably attached to the second frame 216 so that the distance between the support and collecting rollers 226, 228 can be adjusted. In some embodiments, the collecting roller 228 is moveably attached to the second frame 216 such that the collecting roller 228 moves away from the support roller 226 as the backing layer 204 accumulates. In some embodiments, a biasing member 217 is attached to the collecting roller 228 and the second frame 216 so that the collecting roller 228 is biased toward the support roller 226. In embodiments where the collecting roller 228 is moveably attached to the second frame 216, the biasing member 217 biases the collecting roller 228 against the support roller 226 to facilitate collecting the backing layer 204 on the collecting roller 228. While the biasing member 217 is shown in FIG. 3 as including a compression spring, the biasing member 217 may include any means of biasing the collecting roller 228 against the support roller 226, such as, for example, an elastic band, a tension spring, or the like. In another embodiment (not shown), the collecting roller may include a first, enlarged portion (e.g., end portions) that engages the support roller, and a second, recessed portion (e.g., a middle portion) sufficiently spaced from the support roller to accommodate an accumulated roll of the backing layer.

To prepare the roll 200 of self-adhered membrane for installation on the building surface 201, an installer unrolls a portion of the membrane from the roll 200 and manually feeds it around the feeding and pressure rollers 224, 222 as shown in FIG. 3. The installer then peels away the backing layer 204 to expose the adhesive side 203 of the membrane layer 202. The installer then affixes the backing layer 204 to the collecting roller 228. The backing layer 204 may be affixed to the collecting roller 228 by any suitable means, such as, for example, a clamp, a split roller, a slot in the collecting roller, one or more fasteners, an adhesive, a barbed or hooked surface, or the like. In some embodiments, the collecting roller 228 is made from a material having a high coefficient of friction to better grip the backing layer 204.

During operation, the installer adheres an unrolled portion of the membrane layer 202 to the building surface 201. The installer presses the pressure and support rollers 222, 226 against the building surface 201 and moves the installation device 210 down the building surface 201 to apply more of the membrane 202 to the surface 201. As the installation device 210 is moved downward, the portion of the membrane layer 202 attached to the building surface 201 draws more of the membrane from the roll 200 through the feeding roller 224 to the pressure roller 222 with its adhesive side 203 facing the building surface 201. The pressure roller 222 is pressed against the membrane layer 202 to ensure that it adheres properly to the building surface 201, thereby eliminating the post-adhesion rolling step from the manual installation of a self-adhered membrane product and reducing installation time.

Movement of the device 200 down the building surface 201 causes the pressure and support rollers 222, 226 to rotate counter-clockwise against the building surface 201, as indicated in FIG. 3. The pressure roller 222 rolls over the membrane layer 202 to apply it to the building surface 201 and to pull more of the membrane from the roll 200. Counter-clockwise rotation of the support roller 226 causes the collecting roller 228 to rotate clockwise to collect the backing layer 204, also pulling more of the membrane from the roll 200. The backing layer 204 is separated from the membrane layer 202 as the membrane layer 202 is pulled by the pressure roller 222 and the backing layer 204 is directed around the feeding roller 224. In other embodiments, the position of the feeding roller 224 may be changed to allow the membrane separation location to be changed. As the membrane layer 202 is dispensed from the roll 200, the collecting roller 228 and support roller 226 continuously pull the backing layer 204 away from the membrane layer 202 to expose the adhesive side 203 of the membrane layer 202 before the membrane layer 202 is applied to the building surface 201.

The handle 218 extends from the base 212 so that a worker can guide the installation device 210 as the sheet is installed. While the handle 218 is shown in FIG. 2 as a U-shaped bar, the handle 218 may take on any configuration suitable for supporting the installation device 210. For example, the handle 218 could be integrated into the base 212, or could include two posts extending from the base 212. The handle 218 may also include grips (not shown) so that a worker can more securely hold onto the handle 218 and to reduce hand fatigue. In some embodiments, the grips are made of rubber and have a 1 inch diameter and a ½ inch standoff at each end of the grip (not shown). The distance between the gripping locations of the handle 218 is less than the width of the roll 200 of self-adhered sheet, thereby allowing a person to install a wider roll of material than they could using a manual installation method. In some embodiments, the handle 218 is made from a ¾ inch diameter metal tube, such as aluminum or steel tube, or the like.

The installation device 210 may also include a cut off plate (not shown) that provides support when a worker cuts the self-adhered membrane with a blade when the end of a building surface is reached. The cut off plate may also include a cut off blade (not shown) allowing the membrane to be cut without the use of a separate cutting device. The cut-off plate may be located in many different locations on the installation device 210. For example, the cut-off plate may be positioned between the roll 200 and the feeding roller 224 such that the membrane 202 can be cut before the backing layer 204 is separated. Alternatively, the cut-off plate may be positioned between the feeding roller 224 and the pressure roller 222 so that the membrane 202 can be cut just before it is applied to the building surface 201. Alternatively, the cut-off plate may be positioned near the pressure roller 222 such that the membrane 202 can be cut after it has been applied to the building surface 201.

When the device 210 is vertically oriented, as when the membrane 202 is being applied to a vertical surface (as shown in FIGS. 2 and 3), the installer supports the device 210 by holding the handle 218 and pressing the device 210 against the wall 201. The holding force 300 exerted by the installer is transferred through the body 212 and the first and second frames 214, 216 to the pressure and support rollers 222, 226, respectively. The holding force 300 transferred to the pressure roller 222 results in a pressure force 302 that presses the membrane 202 against the surface 201 during installation.

The weight of the device 210 and the roll 200 are also supported by a membrane tension force 304 of the already installed membrane, and by a support force 306 provided by the support roller 226 as it is pressed against the building surface 201. The membrane tension force 304 is equal to the amount of weight that the already applied membrane 202 can support, up to a maximum force based on the tensile strength of the membrane 202. By stopping or slowing the rotation of the roll 200, the device 210 can take advantage of the installed membrane and be at least partially supported by the membrane tension force 304. In some embodiments, the membrane 202 is strong enough to support the entire device 210 and roll 200. The support force 306 results from the rolling resistance of the support roller 226 as the device 201 is pressed against and moved down the building surface 201. In some embodiments, the rolling resistance of the support roller 226 can be adjusted or stopped to control the rotation of the support roller 226 and the amount of support force 306.

The holding force 300 exerted by the installer supports the weight of the device 210 and roller 200 in excess of the membrane tension and support forces 304, 306. In addition, the amount of holding force 300 necessary to support the device 210 is reduced because of the positioning of the roll 200 between the handle 218 and the support roller 226. During use, the device 210 pivots on the support roller 226 as it is pressed against the building surface 201, thereby forming a second class lever out of the body 212 and second frame 216, with the support roller 226 as a fulcrum. The mechanical advantage provided by this configuration of the device 210 reduces the weight that the installer must support with the holding force 300.

Using an installation device, such as the illustrated installation device 210, to apply a self-adhered membrane to a building allows a single worker to complete an installation process that may require multiple people when carried out manually. The installation of the self-adhered sheet using the device 210 reduces installation times and makes it easier to properly align a self-adhered sheet even with larger and heavier rolls of material. For example, the mechanical advantage provided by the frame allows a worker to more easily support a roll of material against the wall of a building, and therefore more easily maneuver the roll as the membrane is applied. Additionally, the incorporation of a pressure roller eliminates an additional pressing step that would otherwise need to be performed. The lightweight nature of the device 210 also it can be used in applications where an installer normally could not hold a large roll of self-adhered sheet, such as, for example, while riding in a lift.

Figure 4:
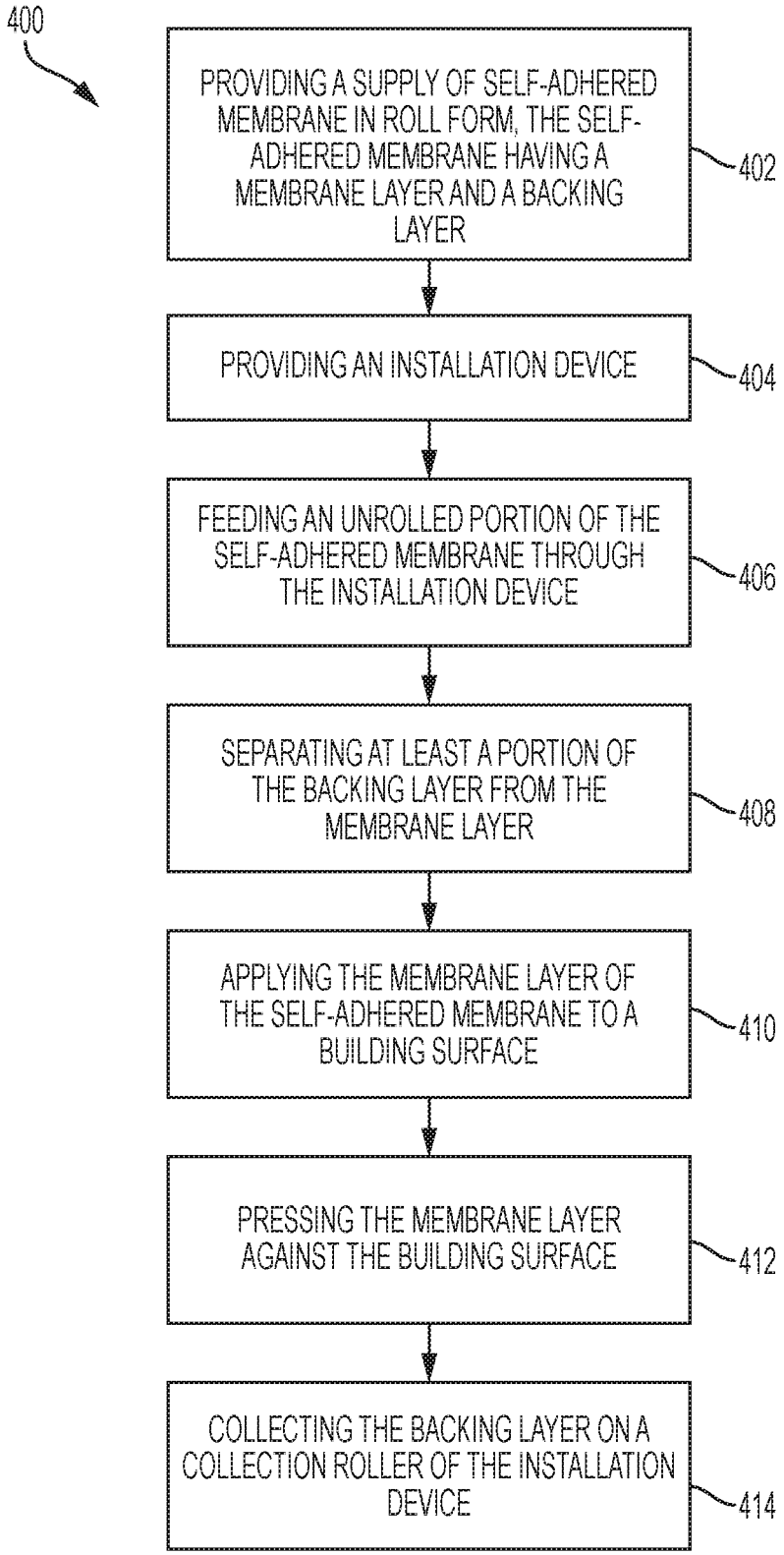
FIG. 4 is a flow chart describing the steps of an exemplary method of using a self-adhered sheet installation device.

Referring now to FIG. 4, a flow chart of an exemplary method 400 of using a self-adhered sheet installation device is shown. The exemplary method 400 includes: providing a supply of self-adhered membrane in roll form, the self-adhered membrane having a membrane layer and a backing layer, at 402; providing an installation device, at 404; feeding an unrolled portion of the self-adhered membrane through the installation device, at 406; separating at least a portion of the backing layer from the membrane layer, at 408; applying the membrane layer of the self-adhered membrane to a building surface, at 410; pressing the self-adhered membrane against the building surface, at 412; and collecting the backing layer on a collection roller of the installation device, at 414. The exemplary method 400 can be implemented with any of the exemplary installation devices described above, or another installation device. In some embodiments, the separating 408, applying 410, pressing 412, and collecting 414 steps are performed simultaneously.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, many of the features describe above may be used with a device to apply a self-adhered membrane that does not include a backing layer or liner, or with a membrane that is not self-adhered and requires that adhesive be applied to a building surface before or during application of the membrane. As another example, the width of the installation device may be widened or narrowed to accommodate wider or narrower rolls of self-adhered membrane. As another example, the steps of all processes and methods herein can be performed in any order, unless two or more steps are expressly stated as being performed in a particular order, or certain steps inherently require a particular order. Accordingly, departures may be made from such details without departing from the spirit or scope of the applicant's general inventive concept.

As described herein, when one or more components are described as being connected, joined, affixed, coupled, attached, or otherwise interconnected, such interconnection may be direct as between the components or may be in direct such as through the use of one or more intermediary components. Also as described herein, reference to a "member," "component," or "portion" shall not be limited to a single structural member, component, or element but can include an assembly of components, members or elements. Also as described herein, the terms "substantially" and "about" are defined as at least close to (and includes) a given value or state (preferably within 10% of, more preferably within 1% of, and most preferably within 0.1% of).

While various inventive aspects, concepts and features of the disclosures may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts and features of the disclosures—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present application even if such embodiments are not expressly disclosed herein. Additionally, even though some features, concepts or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated. Moreover, while various aspects, features and concepts may be expressly identified herein as being inventive or forming part of an disclosure, such identification is not intended to be exclusive, but rather there may be inventive aspects, concepts and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. A self-adhered membrane installation device comprising:

a base frame;

at least one handle extending from the base frame;

a first frame extending from a first side of the base frame;

a second frame extending from a second side of the base frame;

a carrier for rotatably receiving a roll of self-adhered membrane and positioned so that the roll of self-adhered membrane does not contact a building surface when the installation device is applied to the building surface;

a pressure roller rotatably attached to the first frame and positioned so that at least a portion of the pressure roller presses an adhesive membrane layer of the self-adhered membrane against the building surface when the installation device is applied to the building surface;

a support roller rotatably attached to the second frame and positioned so that at least a portion of the pressure roller engages the building surface when the installation device is applied to the building surface; and a collecting roller rotatably attached to the second frame and positioned so that at least a portion of the collecting roller engages the support roller such that rotation of the support roller causes the collecting roller to rotate to collect a backing layer of the self-adhered membrane on a center portion of the collecting roller.

2. The self-adhered membrane installation device according to claim 1, wherein the first side of the base frame is above the second side of the base frame when the installation device is applied to the building surface.

3. The self-adhered membrane installation device according to claim 1, wherein a middle portion of the collecting roller engages the support roller.

4. The self-adhered membrane installation device according to claim 1, wherein the collecting roller includes a slot for receiving the backing layer of the self-adhered membrane for securing the backing layer to the collecting roller.

5. The self-adhered membrane installation device according to claim 1, further comprising a biasing member that biases the collecting roller against the support roller.

6. The self-adhered membrane installation device according to claim 1, wherein the collecting roller is moveably attached to the second frame and the collecting roller moves away from the support roller as the backing layer is collected on the collecting roller.

7. The self-adhered membrane installation device according to claim 1, wherein the support roller is configured to provide increased rolling resistance to provide support for the device during application of the self-adhered membrane.

8. The self-adhered membrane installation device according to claim 1, further comprising a feeding roller positioned between the carrier and the pressure roller and arranged to direct the adhesive membrane layer toward the pressure roller and the backing layer toward the collecting roller.

9. The self-adhered membrane installation device according to claim 8, further comprising a cutter for cutting the self-adhered membrane, wherein the cutter is positioned between the feeding roller and the carrier.

10. The self-adhered membrane installation device according to claim 1, further comprising a level indicator.

11. The self-adhered membrane installation device according to claim 1, further comprising a cutter for cutting the self-adhered membrane.

12. A self-adhered membrane installation device in combination with a roll of self-adhered membrane having an adhesive membrane layer and a backing layer, the device comprising:

a base frame;

at least one handle extending from the base frame;

a first frame extending from a first side of the base frame;

a second frame extending from a second side of the base frame;

a carrier for rotatably receiving the roll of self-adhered membrane and positioned so that the roll of self-adhered membrane does not contact a building surface when the installation device is applied to the building surface;

a pressure roller rotatably attached to the first frame and positioned so that at least a portion of the pressure roller presses the adhesive membrane layer of the self-adhered membrane against the building surface when the installation device is applied to the building surface;

a support roller rotatably attached to the second frame and positioned so that at least a portion of the pressure roller engages the building surface when the installation device is applied to the building surface; and a collecting roller rotatably attached to at least one of the base frame, the first frame, and the second frame and configured to rotate to collect the backing layer of the self-adhered membrane;

wherein the roll of self-adhered membrane is rotatably installed on the carrier; and wherein the self-adhered membrane is unrolled by the self-adhered membrane installation device.

13. The combination of claim 12, wherein rotation of the support roller causes the collecting roller to rotate to collect a backing layer of the self-adhered membrane on the collecting roller.

14. The combination of claim 12, further comprising a feeding roller positioned between the carrier and the pressure roller and arranged to direct the adhesive membrane layer toward the pressure roller and the backing layer toward the collecting roller.

15. The combination of claim 12, further comprising a cutter for cutting the self-adhered membrane.

16. A method of installing self-adhered membrane comprising:

using an installation device comprising:

a base frame;

at least one handle extending from the base frame;

a first frame extending from a first side of the base frame;

a second frame extending from a second side of the base frame;

a carrier rotatably attached to at least one of the base frame, the first frame, and the second frame;

a pressure roller rotatably attached to the first frame;

a support roller rotatably attached to the second frame; and a collecting roller rotatably attached to at least one of the base frame, the first frame, and the second frame;

mounting a roll of self-adhered membrane to the carrier of the installation device, the self-adhered membrane having an adhesive membrane layer and a backing layer;

feeding an unrolled portion of the self-adhered membrane through the installation device;

separating at least a portion of the backing layer from the adhesive membrane layer;

applying the adhesive membrane layer of the self-adhered membrane to a building surface;

pressing the adhesive membrane layer against the building surface with the pressure roller; and collecting the backing layer on the collection roller of the installation device.

17. The method of claim 16, wherein the separating, applying, pressing, and collecting steps occur simultaneously.

18. The method of claim 16, wherein rotation of the support roller causes the collecting roller to rotate to collect a backing layer of the self-adhered membrane on the collecting roller.

19. The method of claim 16, further comprising a feeding roller positioned between the carrier and the pressure roller and arranged to direct the adhesive membrane layer toward the pressure roller and the backing layer toward the collecting roller.

20. The method of claim 16, further comprising:

cutting the self-adhered membrane with a cutter attached to the installation device.

* * * * *